US006029634A

United States Patent [19]

Graham

[11] Patent Number: 6,029,634

[45] Date of Patent: Feb. 29, 2000

[54] FUEL METERING SYSTEM

[76] Inventor: Glenn L. Graham, P.O. Box 263, Brightwood, Oreg. 97011

[21] Appl. No.: 09/118,094

[22] Filed: Jul. 17, 1998

[51] Int. Cl.[7] ..... F02M 37/04

[52] U.S. Cl. ..... 123/510; 123/511; 123/458; 123/514

[58] Field of Search ..... 123/510, 511, 123/506, 514, 457, 458, 459

[56] References Cited

U.S. PATENT DOCUMENTS

| | | | |
|---|---|---|---|
| 3,724,435 | 4/1973 | Bier | 123/457 |
| 4,206,735 | 6/1980 | Miles et al. | 123/458 |
| 4,838,232 | 6/1989 | Wich | 123/458 |
| 5,626,114 | 5/1997 | Kushida et al. | 123/511 |
| 5,727,515 | 3/1998 | Biester | 123/511 |
| 5,785,025 | 7/1998 | Yoshiume et al. | 123/511 |

*Primary Examiner*—Thomas N. Moulis

[57] ABSTRACT

A new fuel metering system for selectively controlling the rack pressure and the volume of fuel available to a diesel engine. The inventive device includes a fuel inlet line in fluid communication with a fuel pump outlet line for receiving fuel flowing from the fuel pump, a metering valve coupled in fluid communication with the fuel inlet line, the metering valve having a valve member for controlling the flow of fuel therethrough, the metering valve being coupled in fluid communication with a return line for receiving the metered fuel flowing through the metering valve, and a solenoid valve coupled in fluid communication with the metering valve and the fuel inlet line, the solenoid valve being operable to open and close fuel flow through the metering valve.

14 Claims, 2 Drawing Sheets

15
25
20
12
18
27
24
21
26
13
10
22
14
16

32
33
P
39
38
34
31
35
30
36
37

42
43
P
49
48
44
40
41
45
46
47

FUEL METERING SYSTEM

BACKGROUND OF THE INVENTION

1. Field of the Invention

The present invention relates to fuel metering and control systems and more particularly pertains to a new fuel metering system for selectively controlling the rack pressure and the volume of fuel available to a diesel engine.

2. Description of the Prior Art

The use of fuel metering and control systems is known in the prior art. More specifically, fuel metering and control systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art fuel metering and control systems include U.S. Pat. No. 5,448,882 to Dyer et al. The Dyer et al. patent discloses a fuel metering system that independently meters fuel flow to a first and a second set of pilot fuel nozzles, and to a set of main fuel nozzles of a gas turbine engine.

U.S. Pat. No. 5,305,714 to Sekiguchi et al. discloses a fuel supply system for a hydrogen gas engine.

It can then be appreciated that there exists a need for a metering system that selectively controls the rack pressure and the volume of fuel available to a diesel engine. This is particularly desirable in reduced load situations. To achieve this the metering system generally comprises a fuel inlet line in fluid communication with a fuel pump outlet line for receiving fuel flowing from the fuel pump, a metering valve coupled in fluid communication with the fuel inlet line, the metering valve having a means for controlling the flow of fuel therethrough, the metering valve being coupled in fluid communication with a return line for receiving the metered fuel flowing through the metering valve, and a solenoid valve coupled in fluid communication with the metering valve and the fuel inlet line, the solenoid valve being operable to open and close fuel flow through the metering valve.

SUMMARY OF THE INVENTION

In view of the foregoing disadvantages inherent in the known types of fuel metering and control systems now present in the prior art, the present invention provides a new fuel metering system construction wherein the same can be utilized for selectively controlling the rack pressure and the volume of fuel available to a diesel engine.

The general purpose of the present invention, which will be described subsequently in greater detail, is to provide a new fuel metering system apparatus and method which has many of the advantages of the fuel metering and control systems mentioned heretofore and many novel features that result in a new fuel metering system which is not anticipated, rendered obvious, suggested, or even implied by any of the prior art fuel metering and control systems, either alone or in any combination thereof.

To attain this, the present invention generally comprises a fuel inlet line in fluid communication with a fuel pump outlet line for receiving fuel flowing from the fuel pump, a metering valve coupled in fluid communication with the fuel inlet line, the metering valve having a means for controlling the flow of fuel therethrough, the metering valve being coupled in fluid communication with a return line for receiving the metered fuel flowing through the metering valve, and a solenoid valve coupled in fluid communication with the metering valve and the fuel inlet line, the solenoid valve being operable to open and close fuel flow through the metering valve.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fuel metering system apparatus and method which has many of the advantages of the fuel metering and control systems mentioned heretofore and many novel features that result in a new fuel metering system which is not anticipated, rendered obvious, suggested, or even implied by any of the prior art fuel metering and control systems, either alone or in any combination thereof.

It is another object of the present invention to provide a new fuel metering system which may be easily and efficiently manufactured and marketed.

It is a further object of the present invention to provide a new fuel metering system which is of a durable and reliable construction.

An even further object of the present invention is to provide a new fuel metering system which is susceptible of a low cost of manufacture with regard to both materials and labor, and which accordingly is then susceptible of low prices of sale to the consuming public, thereby making such fuel metering system economically available to the buying public.

Still yet another object of the present invention is to provide a new fuel metering system which provides in the apparatuses and methods of the prior art some of the advantages thereof, while simultaneously overcoming some of the disadvantages normally associated therewith.

Still another object of the present invention is to provide a new fuel metering system for selectively controlling the rack pressure and the volume of fuel available to a diesel engine.

Yet another object of the present invention is to provide a new fuel metering system which includes a fuel inlet line in fluid communication with a fuel pump outlet line for receiving fuel flowing from the fuel pump, a metering valve coupled in fluid communication with the fuel inlet line, the metering valve having a means for controlling the flow of fuel therethrough, the metering valve being coupled in fluid communication with a return line for receiving the metered fuel flowing through the metering valve, and a solenoid valve coupled in fluid communication with the metering valve and the fuel inlet line, the solenoid valve being operable to open and close fuel flow through the metering valve.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
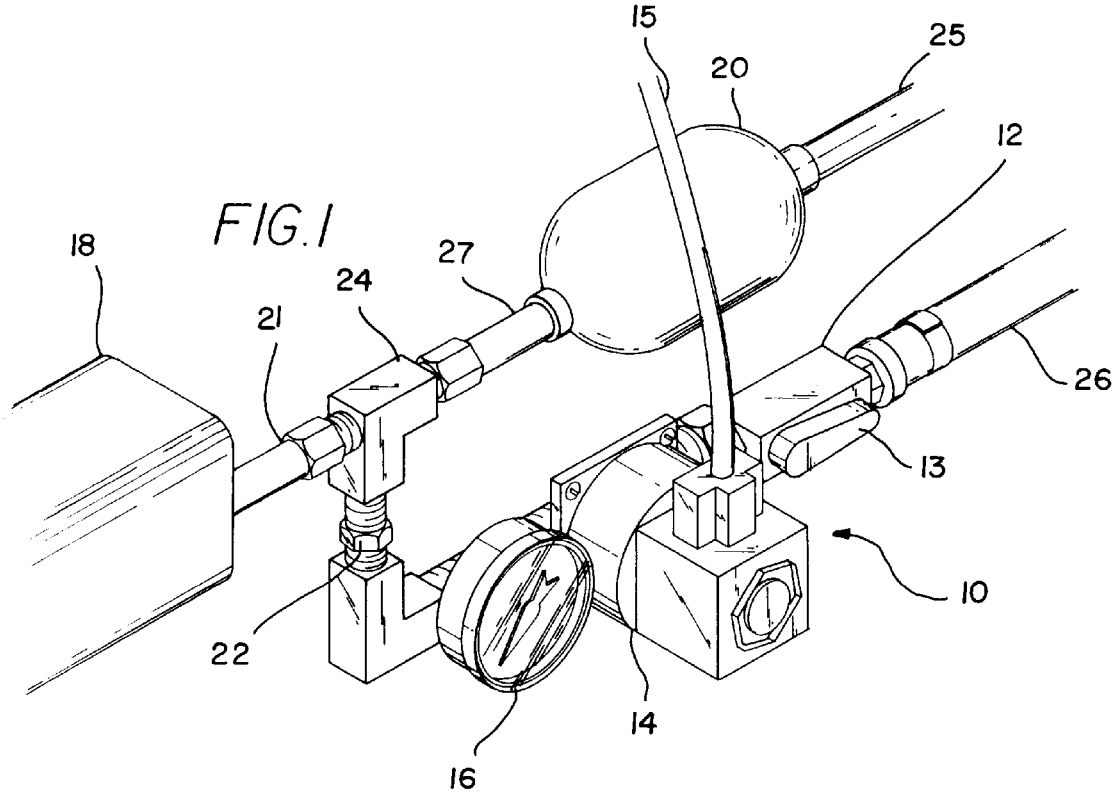
FIG. 1 is a left side perspective view of a new fuel metering system according to the present invention.
Figure 2:
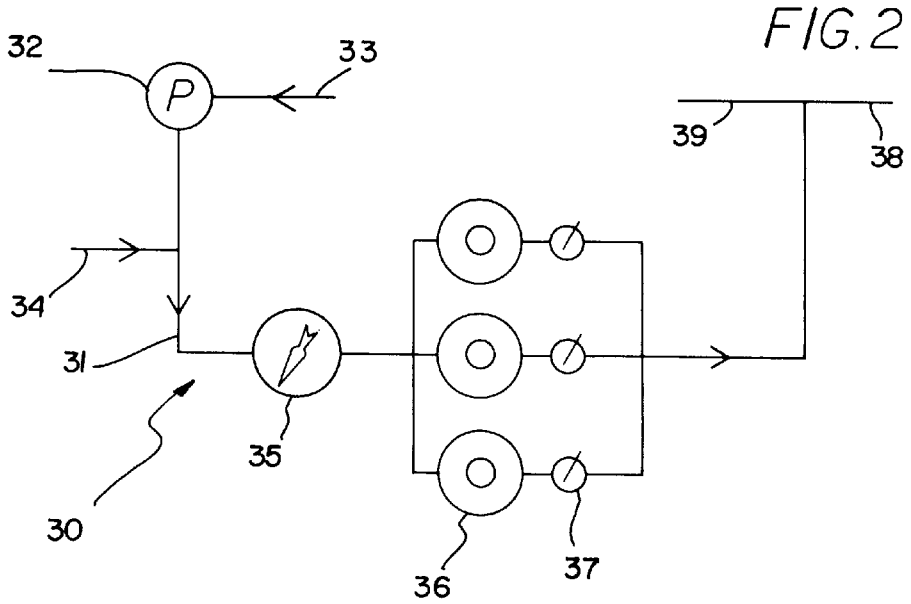
FIG. 2 is a schematic view of an alternative embodiment of the present invention.
Figure 3:
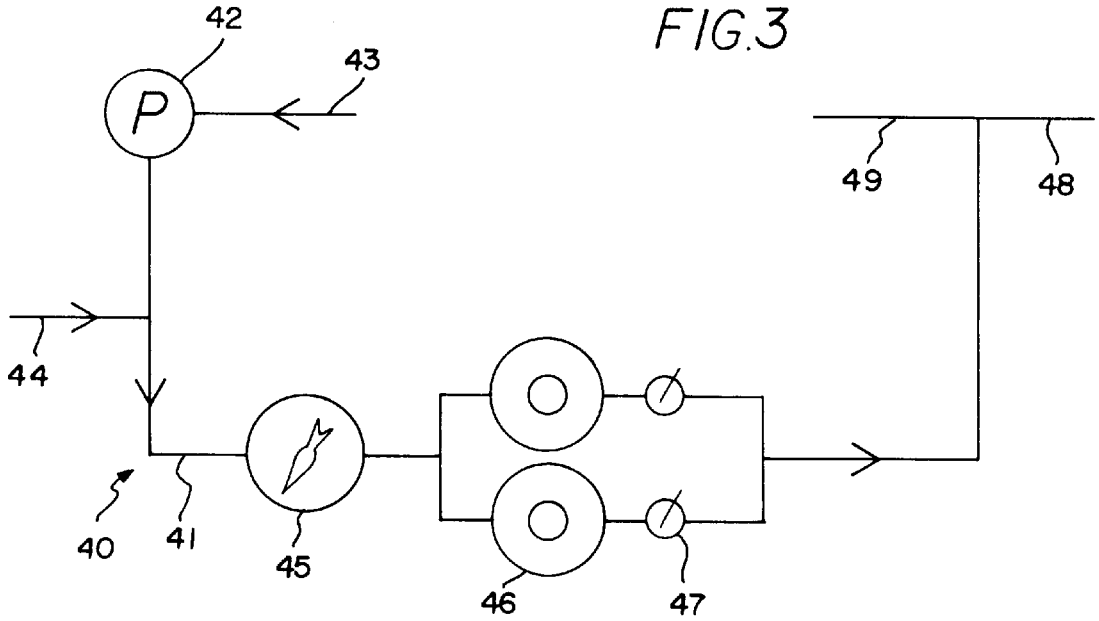
FIG. 3 is a schematic view of yet another embodiment of the present invention.

With reference now to the drawings, and in particular to FIGS. 1 through 3 thereof, a new fuel metering system embodying the principles and concepts of the present invention and generally designated by the reference numeral 10 will be described.

More specifically, it will be noted that the fuel metering system 10 comprises a fuel inlet line 22, a metering valve 12, and a solenoid valve 14. Alternatively, additional metering valves and solenoids coupled in series are coupled in parallel to achieve greater control over the flow through the fuel inlet line 22.

With reference to FIG. 1 there is shown a fuel pump 18 having an outlet line 21. Shown coupled to the fuel pump 18 in fluid communication is a fuel filter 20 having an inlet line 27 and an outlet line 25. Shown coupled in fluid communication through a coupling 24 to the fuel pump outlet line 21 and the fuel filter inlet line 27 is the fuel inlet line 22.

A metering valve 12, which in the preferred embodiment includes a ball valve having a means for controlling the flow of fuel therethrough such as a valve member (not shown), is shown coupled in fluid communication with the fuel inlet line 22. The metering valve 12 is also coupled in fluid communication with a return line 26 for receiving the metered fuel flowing through the metering valve 12. Shown coupled in fluid communication with the metering valve 12 and the fuel inlet line 22 is a solenoid valve 14 operable to open and close fuel flow through the metering valve 12. The solenoid valve 14 is preferably energizable by a vehicle operator by means of a switch disposed in the cab of the vehicle.

With continued reference to FIG. 1, a pressure gauge 16 is shown coupled in fluid communication with the fuel inlet line 22.

With reference to FIG. 3 there is shown a second metering valve 47 in fluid communication with a fuel inlet line 41. The second metering valve 47 is preferably a ball valve having a means for controlling the flow of fuel therethrough and is shown coupled in fluid communication with the return line 48,49 for receiving the metered fuel flowing through the second metering valve 47. A second solenoid valve 46 is shown coupled in series and in fluid communication with the second metering valve 47. The second solenoid valve 46 is operable to open and close fuel flow through the second metering valve 47 and is preferably energizable from the cab of the vehicle. A pressure gauge 45 is shown coupled in fluid communication with the fuel inlet line 41.

With reference to FIG. 2 a third metering valve 37 is shown in fluid communication with a fuel inlet line 31. The third metering valve 37 is preferably a ball valve having a means for controlling the flow of fuel therethrough. The third metering valve 37 is shown coupled in fluid communication with the return line 38,39 for receiving the metered fuel flowing through the third metering valve 37. A third solenoid valve 36 is shown coupled in fluid communication with the third metering valve 37. The third solenoid valve 36 is operable to open and close fuel flow through the third metering valve 37 and is preferably energizable from the cab of the vehicle. A pressure gauge 35 is shown coupled in fluid communication with the fuel inlet line 31.

Alternatively, the fuel metering system 10 of the present invention may be coupled to a fuel return line distal to the metering orifice. In the embodiment, the metering valve is coupled in fluid communication with the fuel inlet line which in turn is coupled to the fuel return line. The metering valve is also coupled to the fuel return line for receiving the metered fuel flowing through the metering valve. A solenoid valve is coupled in fluid communication with the metering valve and the fuel inlet line and is operable to open and close fuel flow through the metering valve. As in the other embodiments of the present invention the metering valve is preferably a ball valve and more than one series combination of metering valve/solenoid valve may be coupled in parallel. Additionally, a pressure gauge may be coupled to the fuel inlet line.

In use, the metering valves are adjusted to control the fuel flow with the solenoid valve open. The desired pressure is observable by means of the pressure gauge. When the load upon the diesel engine is reduced, the solenoid valves can be opened to thereby restrict the flow of fuel to the engine.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fuel metering system for use with a diesel engine having a fuel pump in fluid communication with a fuel filter comprising:

a fuel inlet line in fluid communication with a fuel pump outlet line for receiving fuel flowing from the fuel pump, the fuel inlet line being coupled to the fuel pump outlet line between the fuel pump and the fuel filter;

a metering valve coupled in fluid communication with the fuel inlet line, the metering valve having a means for controlling the flow of fuel therethrough, the metering valve being coupled in fluid communication with a return line for receiving the metered fuel flowing through the metering valve; and a solenoid valve coupled in fluid communication with the metering valve and the fuel inlet line, the solenoid valve being operable to open and close fuel flow through the metering valve.

2. The fuel metering system of claim 1, wherein the metering valve is a ball valve.

3. The fuel metering system of claim 1 further comprising a pressure gauge in fluid communication with the fuel inlet line.

4. The fuel metering system of claim 1 further comprising a second metering valve in fluid communication with the fuel inlet line, the second metering valve having a means for controlling the flow of fuel therethrough, the second metering valve being coupled in fluid communication with the return line for receiving the metered fuel flowing through the second metering valve and further comprising a second solenoid valve coupled in fluid communication with the second metering valve, the second solenoid valve being operable to open and close fuel flow through the second metering valve.

5. The fuel metering system of claim 4 further comprising a third metering valve in fluid communication with the fuel inlet line, the third metering valve having a means for controlling the flow of fuel therethrough, the third metering valve being coupled in fluid communication with the return line for receiving the metered fuel flowing through the third metering valve and further comprising a third solenoid valve coupled in fluid communication with the third metering valve, the third solenoid valve being operable to open and close fuel flow through the third metering valve.

6. The fuel metering system of claim 4, wherein the second metering valve is a ball valve.

7. The fuel metering system of claim 5, wherein the third metering valve is a ball valve.

8. The fuel metering system of claim 4 further comprising a pressure gauge in fluid communication with the fuel inlet line.

9. The fuel metering system of claim 5 further comprising a pressure gauge in fluid communication with the fuel inlet line.

10. A fuel metering system for use with a diesel engine having a fuel return line and a metering orifice comprising:

a fuel inlet line in fluid communication with a fuel return line for receiving fuel flowing therethrough, the fuel inlet line being coupled to the fuel return line distally of the metering orifice;

a metering valve coupled in fluid communication with the fuel inlet line, the metering valve having a means for controlling the flow of fuel therethrough, the metering valve being coupled in fluid communication with the return line for receiving the metered fuel flowing through the metering valve; and a solenoid valve coupled in fluid communication with the metering valve and the fuel inlet line, the solenoid valve being operable to open and close fuel flow through the metering valve.

11. The fuel metering system of claim 10, wherein the metering valve is a ball valve.

12. The fuel metering system of claim 10, further comprising a pressure gauge in fluid communication with the fuel inlet line.

13. The fuel metering system of claim 10, further comprising a second metering valve in fluid communication with the fuel inlet line, the second metering valve having a means for controlling the flow of fuel therethrough, the second metering valve being coupled in fluid communication with the return line for receiving the metered fuel flowing through the second metering valve and further comprising a second solenoid valve coupled in fluid communication with the second metering valve, the second solenoid valve being operable to open and close fuel flow through the second metering valve.

14. The fuel metering system of claim 11 further comprising a third metering valve in fluid communication with the fuel inlet line, the third metering valve having a means for controlling the flow of fuel therethrough, the third metering valve being coupled in fluid communication with the return line for receiving the metered fuel flowing through the third metering valve and further comprising a third solenoid valve coupled in fluid communication with the third metering valve, the third solenoid valve being operable to open and close fuel flow through the third metering valve.

* * * * *